United States Patent [19]

Iizuka et al.

[11] Patent Number: 5,052,837

[45] Date of Patent: Oct. 1, 1991

[54] MAKEUP LIQUID CONTAINER WITH APPLICATOR

[75] Inventors: Shigeo Iizuka; Takao Kishi; Riichi Ogawa; Hiroshi Mizushima, all of Tokyo, Japan

[73] Assignee: Yoshino Kogyosho Co., Ltd., Tokyo, Japan

[21] Appl. No.: 567,167

[22] Filed: Aug. 14, 1990

Related U.S. Application Data

[62] Division of Ser. No. 283,972, Dec. 13, 1988, Pat. No. 4,960,339.

[30] Foreign Application Priority Data

Jul. 13, 1988 [JP] Japan ..... 63-92877
Jul. 15, 1988 [JP] Japan ..... 63-93780
Jul. 18, 1988 [JP] Japan ..... 63-94782

[51] Int. Cl.[5] ..... A46B 11/00

[52] U.S. Cl. ..... 401/4; 401/122; 401/126; 401/127

[58] Field of Search ..... 401/4, 129, 122, 130, 401/127, 126, 128; 132/317

[56] References Cited

U.S. PATENT DOCUMENTS 2,990,834 7/1961 Amen ..... 401/129
3,084,374 4/1963 Ziegler ..... 401/122
3,738,760 6/1973 Madeira ..... 401/4
4,290,706 9/1981 Wandl ..... 401/4

FOREIGN PATENT DOCUMENTS 2127748 12/1972 Fed. Rep. of Germany .

*Primary Examiner*—Danton D. DeMille
*Attorney, Agent, or Firm*—Oliff & Berridge

[57] ABSTRACT

A makeup liquid container designed to enable scraping a makeup liquid off the inner surface of the container. The container has a container body with an opening, a cap fitted on the container body so as to close the opening, an applicator shaft fixed at its one end to the container body and adapted to be inserted into the container body when the cap is fitted on the container body, and an applicator such as a brush fixed to the other end of the applicator shaft. The container further has a slider capable of sliding along the inner surface of the container body so as to scrape makeup liquid off the inner surface of the container body. The sliding motion of the slider is caused by the applicator shaft which is moved into and out of the container body when the user pulls or presses the cap up and down or, alternatively, the slider is freed from the applicator shaft so as to move up and down in the container body as the container body is shaken.

1 Claim, 13 Drawing Sheets

MAKEUP LIQUID CONTAINER WITH APPLICATOR

This is a division of application Ser. No. 07/283,972 filed Dec. 13, 1988 now U.S. Pat. No. 4,960,339.

BACKGROUND OF THE INVENTION

1. Field of the Invention

The present invention relates to a makeup liquid container with an applicator, such as, for example, a mascara liquid container or an eye liner liquid container with a brush or a similar applicator.

2. Description of the Prior Art

In general, a makeup liquid container with an applicator has a container body which contains the makeup liquid, a closure cap, and an applicator such as a brush with a shaft which is fixed to the cap and which is long enough to enable the applicator to reach the bottom of the container body. The end of the applicator therefore is always immersed in the liquid. The user pinches the cap and pulls the applicator out of the container through a squeezing sleeve provided in the opening portion of the container thereby squeezing off any excessive liquid.

Makeup liquids such as mascara and eye liner are usually viscous and tend to attach to the inner surface of the container body when left for a long time. As a consequence, the amount of the liquid which can effectively be used is decreased and, in addition, the density of the makeup liquid is changed undesirably.

SUMMARY OF THE INVENTION

Accordingly, an object of the present invention is to provide a makeup liquid container with an applicator which is improved in such a way as to enable the liquid, attached to the inner surface of the container body, to be scraped off thereby overcoming the above-described problems of the prior art.

To this end, according to one aspect of the present invention, there is provided a makeup liquid container with an applicator comprising: a container body having an opened neck portion; a closure cap for closing the opening of the neck portion; an applicator shaft fixed at one end to the cap such as to extend downwardly therefrom into the container body when the cap is placed to cover the opening of the container; an applicator such as a brush fixed to the other end of the applicator shaft; and a slider slidable along the inner surface of the container body as to for scraping makeup liquid deposited on the inner surface of the container body.

The slider may be arranged such that it is operatively connected to the applicator shaft or the applicator in such a manner that the slider is made to slide along the inner surface of the container body downwardly when the applicator and applicator shaft are inserted into the container body, i.e., when the cap is put on the container body to close the opening, and upwardly when the cap is lifted to withdraw the applicator and the applicator shaft out of the container body.

Alternatively, the slider may be mounted such that it slides up and down along the inner surface of the container body as the container body is shaken.

The above and other objects, features and advantages of the present invention will become clear from the following description of the preferred embodiments when the same is read in conjunction with the accompanying drawings.

BRIEF DESCRIPTION OF THE DRAWINGS

FIG. 17(*b*) is a perspective view of a slider incorporated in the ninth embodiment;

FIG. 19(*b*) is a perspective view of a slider incorporated in the tenth embodiment;

FIG. 20(*b*) is a perspective view of a slider incorporated in the eleventh embodiment;.

DESCRIPTION OF THE PREFERRED EMBODIMENTS

Figure 1:
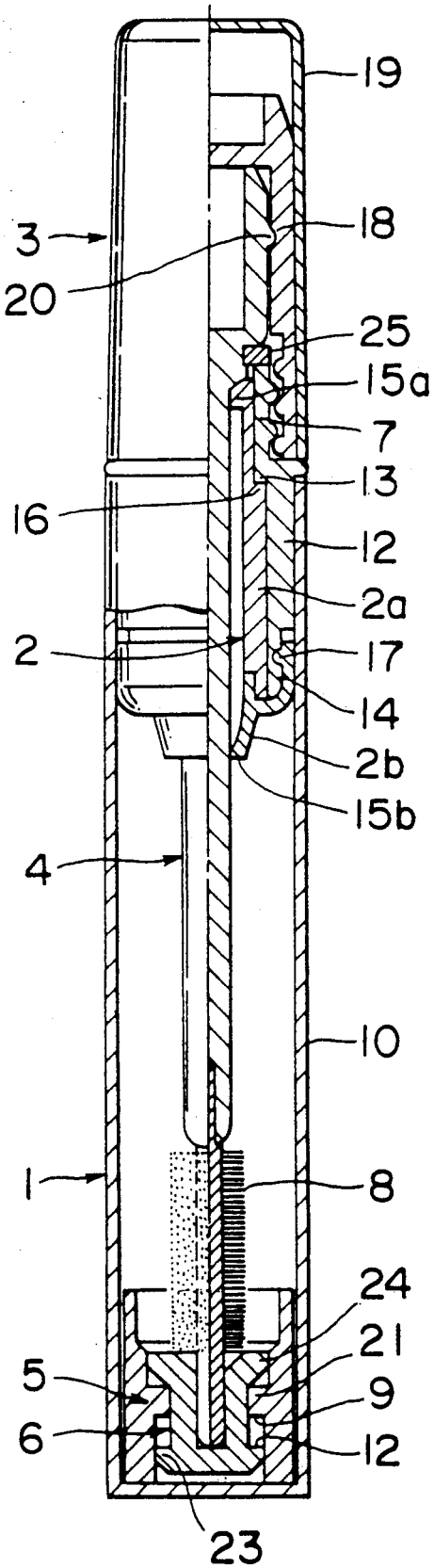
FIG. 1 is a vertical sectional view of a first embodiment of the makeup liquid container with applicator in accordance with the present invention.

Preferred embodiments of the present invention will be described in detail with reference to the accompanying drawings. The preferred embodiments which will be described are generally grouped into two groups. A first group includes embodiments which are shown in FIGS. 1 to 24 in which a slider disposed in a container is engageable with an applicator or an applicator shaft so as to be moved downward by the applicator or the applicator shaft when the applicator or the applicator shaft is moved downward during fitting of a cap on the container and moved upward as the applicator or the applicator shaft is moved upward when the cap is removed from the container to pull the applicator shaft and the applicator out of the container. On the other hand, a second group includes the embodiment illustrated in FIGS. 25 and 26, in which a slider is arranged to slide along the container when the container is shaken.

More specifically, the embodiments shown in FIGS. 1 to 20 have a common feature that, when the applicator shaft inserted into the container body is pushed down as a result of fitting the cap on the container body, the applicator shaft or the applicator pushes down the slider and engages with the same, whereas, when the cap is taken off the container body so as to lift the applicator shaft and the applicator, the applicator shaft or the applicator engaging with the slider causes the slider to slide upward. The applicator shaft or the applicator is then disengaged from the slider when the slider has reached the upper end of its stroke.

First to third embodiments will be described with reference to FIGS. 1 to 6. In each of these embodiments, an applicator shaft is designed to engage with and be disengaged from a slider by means of a gripper.

More particularly, a makeup liquid container with a makeup liquid applicator has an elongated container body 1, a squeezing sleeve 2 fixed in a neck opening of the container body 1, a cap 3 capable of being screwed to the outer surface of the neck 7 of the container body 1, an applicator shaft 4 fixed at its one end to the cap 3 such that, when the cap 3 is set on the container body 1 to close the latter, it extends into the container body 1 through the squeezing sleeve 2, an applicator such as a brush fixed to the other end of the applicator shaft 4, a slider having a generally cylindrical form and capable of sliding along the inner surface of a barrel portion 10 of the container body 1, the inner surface having a greater diameter at an upper region of the barrel portion 10 and a smaller diameter at a lower region of the barrel portion 10, the lower smaller-diameter region having a downwardly facing step 9, and a gripper 6 having a generally cylindrical shape, the upper end portion of the gripper being provided with a plurality of slits arranged in the circumferential direction such that the upper end portion being radially expandable, the gripper being provided in the outer surface thereof with an upwardly facing step 12 for engagement with the downward step 9 of the slider, the gripper being slidably fitted in the slider and is normally received in the smaller-diameter portion of the slider so as to be contracted radially thereby firmly gripping a lower portion of the makeup shaft 4.

The user, when making up, unscrews the cap 3 from the neck 7 of the container body 1 and lifts the cap 3 off the container body 1 so as to pull the makeup shaft 4 fixed to the cap 3. During pulling, the applicator shaft and the applicator are made to pass through the squeezing sleeve 2 so that the makeup liquid attaching to the surface of the applicator shaft 4 and impregnating the applicator such as a brush is wiped and squeezed off to optimize the quantity of the liquid served by the applicator.

The gripper 6 slidably fits in the smaller-diameter portion of the slider so as not to expand radially, i.e., such as to firmly grip the lower end portion of the applicator shaft 4. Therefore, the slider and the gripper 6 spirally rotate together with the applicator shaft 4 during unscrewing of the cap 3 so that the slider scrapes makeup liquid off the inner surface of the barrel 10 of the container body 1. The spiral rotation of the slider and the applicator shaft 4 together with the applicator effectively stirs the makeup liquid in the container so as to effectively prevent sticking of the liquid to the inner surface of the barrel portion 10.

When the slider has reached the upper end of its stroke, it abuts the squeezing sleeve 2 so that the slider cannot rise any more. Meanwhile, further rise of the applicator shaft 4 causes the gripper 6 to further rise as a unit with the applicator shaft 4 so that the gripper 6 slides off the smaller-diameter portion of the slider into the greater-diameter portion of the same. In this state, the gripper is allowed to expand radially so as to release the applicator shaft 4, so that the user can withdraw the applicator shaft 4 without difficulty.

Thus, the first to third embodiments shown in FIGS. 1 to 6 have a common feature which includes, in a makeup liquid container having a slider capable of rotating in sliding contact with the inner surface of the barrel portion 10 of a container body 1 so as to scrape makeup liquid off the inner surface of the barrel portion 10, a gripper 6 through which the slider engages with the makeup shaft 4 in such a manner that the slider is firmly held on the makeup shaft 4 when the makeup liquid container is closed but, when the cap is taken off the container, the applicator shaft 4 can easily be disengaged from the slider.

Figure 2:
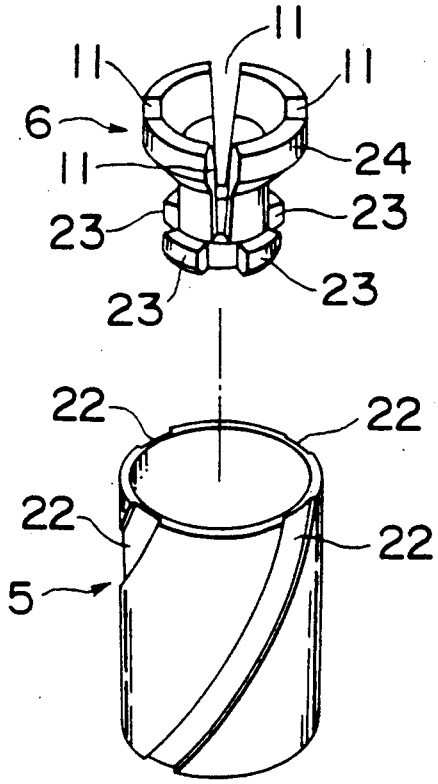
FIG. 2 is an exploded perspective view of an essential portion of the first embodiment particularly showing a slider and a gripper.
Figure 3A:
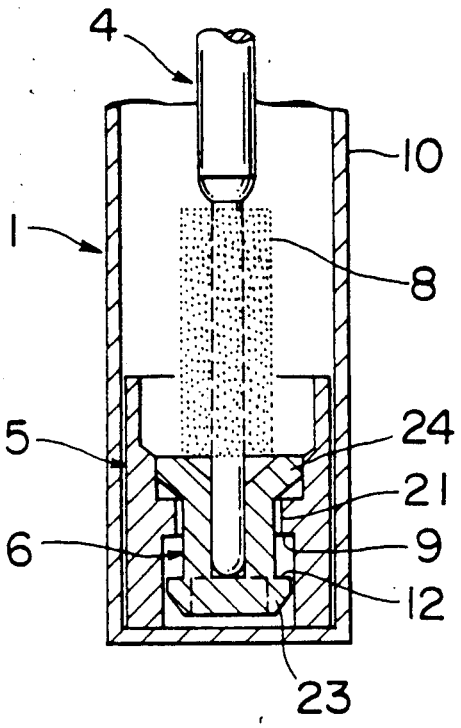
FIGS. 3*a* and 3*b* are sectional views of an essential portion illustrative of the operation of the embodiment shown in FIG. 1.
Figure 3B:
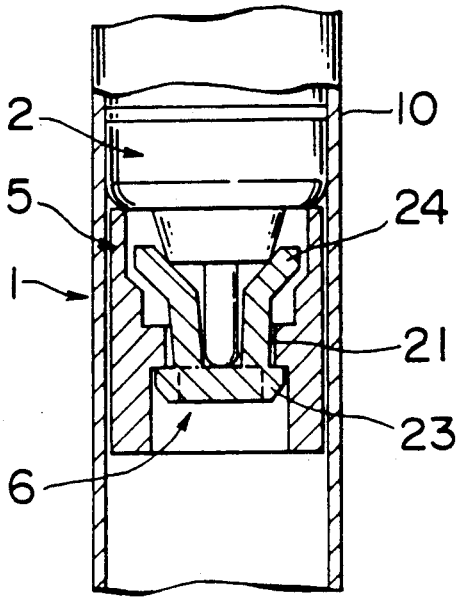

First Embodiment (FIGS. 1,2 and 3(*a*), 3(*b*))

The first embodiment of the makeup liquid container in accordance with the present invention has a container body 1 having an elongated barrel portion 10 with an upper end opening, and a mouth member 12 having an open neck portion 7 and fitted in the upper end opening of the barrel portion 10. The barrel portion is made of a decorative metallic material, while the mouth member 12 is made of a synthetic resin. This, however, is not exclusive and both the barrel portion 10 and the mouth member 7 may be formed from a synthetic resin. The mouth member 12 is provided at an upper inner peripheral portion thereof with a downwardly facing step 13. The lower end portion of the barrel portion 10 is thin-walled so as to leave a gap between itself and the barrel portion 10. An engaging ridge 14 projects from the outer surface of the thin-walled portion such as to project therefrom.

The squeezing sleeve 2 is an elongated tubular member made of a flexible material such as a rubber or a soft synthetic resinous material. In this embodiment, the squeezing sleeve 2 is composed of an upper member **2*a* and a lower member 2*b*, and has squeezing restricted openings at the upper end 15*a* and the lower end 15*b* thereof. The squeezing sleeve 2 further has an upwardly facing step 16 on the upper outer surface thereof and an engaging ridge 17 provided on a lower portion thereof. The squeezing sleeve 2 fits in the mouth member 12 with its upwardly facing step 16 and the engaging ridge 17 held in engagement with the downwardly facing step 13 and the engaging ridge 14**, respectively.

The cap 3 is provided with a screw thread formed in lower end portion of the inner peripheral surface thereof for engagement with screw thread on the outer surface of the open neck portion 7. An engaging recess 18 is formed in the upper portion of the inner peripheral surface of the cap 3 above the screw thread. A metallic coating member 19 made of a decorative metallic material fits on the outer surface of the cap 3, though the provision of the coating member 19 is not essential.

An applicator shaft 4 is capable of extending through the squeezing sleeve 2 into the container body 1 and is provided at its lower end portion with an applicator 8 fixed thereto such as to leave a dripping end. The upper portion of the applicator shaft 4 has a cylindrical form provided with an engaging ridge 20 which engages with the engaging recess 18 so that the applicator shaft 4 is firmly fixed to the cap 3 to form an integral member with the cap 3.

The slider 5 is a substantially tubular member which has an inner peripheral surface which is stepped such that the inside diameter thereof is greater at its upper region than at its lower region. The slider 5 further has an engaging ridge 21 projecting inwardly from the surface of the smaller-diameter lower region of the inner peripheral surface thereof, so that a downwardly facing step 9 is formed. The slider 5 further has a plurality of slant grooves 22 formed in the outer peripheral surface thereof. These grooves 22 serve to scrape any solidified content of the makeup liquid off the inner surface of the barrel portion 10 of the container body 1 and for allowing the makeup liquid to pass therethrough thereby agitating the makeup liquid in the container. The slider 5 is received in the barrel portion 10 of the container body 1 such as to move up and down in sliding contact with the inner surface of the barrel portion 10.

A gripper 6 is a cylindrical member which is provided at its outer lower portion with islands or projections 23 arranged in the circumferential direction so as to provide an upwardly facing step 11. The gripper 6 also has a diverging tapered cylindrical portion 24 which is provided with a plurality of slits 11 arranged in the circumferential direction and extending from the upper end of the tapered cylindrical portion 24 down to the upper face of the projections 23. Thus, the portion of the gripper 6 above the projections 23 are resiliently expandable and contractable in the radial direction, such that this portion of the gripper 6 in the contracted state firmly grips the dripping end of the applicator shaft 4. The gripper 6 is slidably received in the slider 5 with its upwardly facing step 11 engaging with the downwardly facing step 9 of the slider 5.

FIGS. 1 and 3*a* show, respectively, the gripper 6 in ordinary state and in a scraping state. In these states, the gripper 6 is pressed into the lower portion of the slider 5 so as to fit in the smaller-diameter lower region of the slider 5, so that the tapered cylinder portion 24 of the gripper 6 is forcibly contracted radially to firmly grip the applicator shaft 4.

However, when the user pulls the applicator shaft 4 as shown in FIG. 3(*b*), the gripper 6 slides upward along the inner surface of the slider 5 as a result of pulling of the applicator shaft 4. As the tapered cylinder portion 24 of the gripper slides into the large-diameter portion of the slider 5, it is allowed to expand radially so as to release the applicator shaft 4 so that the applicator shaft 4 can be pulled out without difficulty. A reference numeral 25 denotes a packing.

Figure 4:
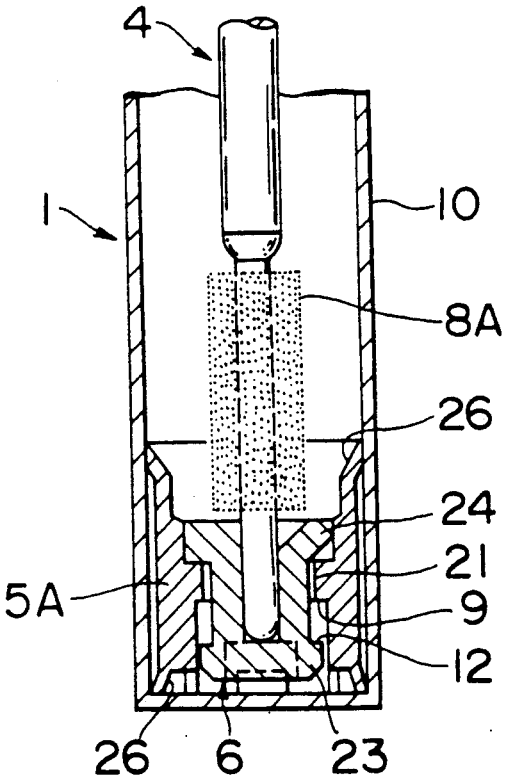
FIG. 4 is a sectional view of an essential portion of a second embodiment.

Second Embodiment (FIG. 4)

In a second embodiment shown in FIG. 4, the outer surface of the slider 5A is devoid of the slant grooves 22 which serve as the scraping portion and also as liquid passages. Instead of such tapered grooves 22, the slider 5A is provided at its upper and lower portions with claws 26, 26 which are inclined outwardly. These claws 26, 26 slide on the inner surface of the barrel portion 10 of the container body 1 thereby scraping makeup liquid off the inner surface of the barrel portion 1. Although not shown in the drawings, each of the claws 26,26 is provided with a plurality of notches arranged in the circumferential direction. Such notches serve as fluid passages and effectively agitate the makeup liquid in the container.

Figure 5:
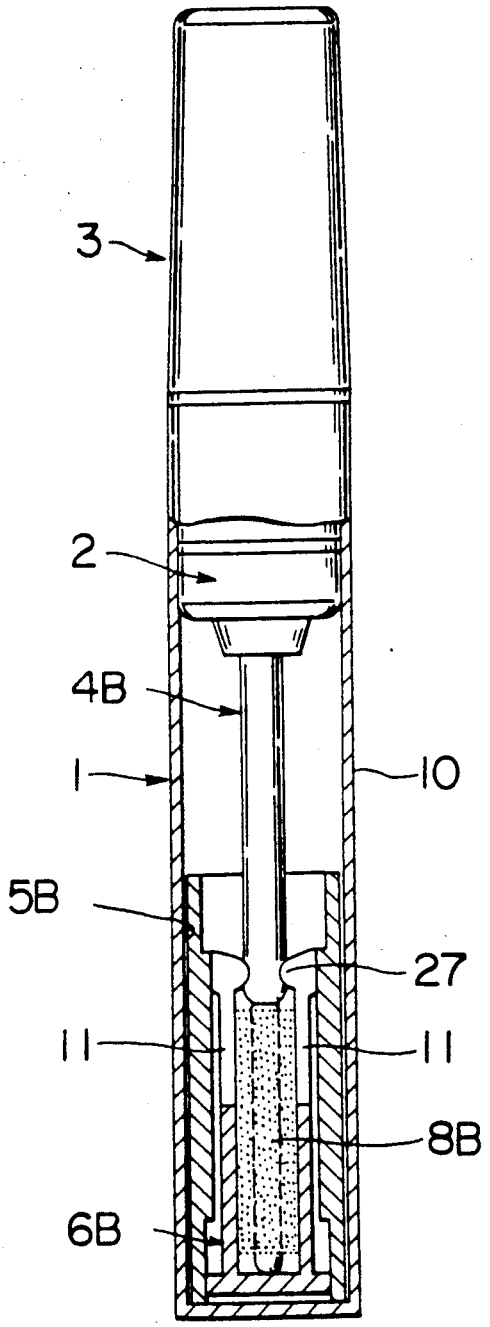
FIGS. 5 and 6 are sectional views of the whole and a part of an essential portion of a third embodiment of the present invention.
Figure 6:
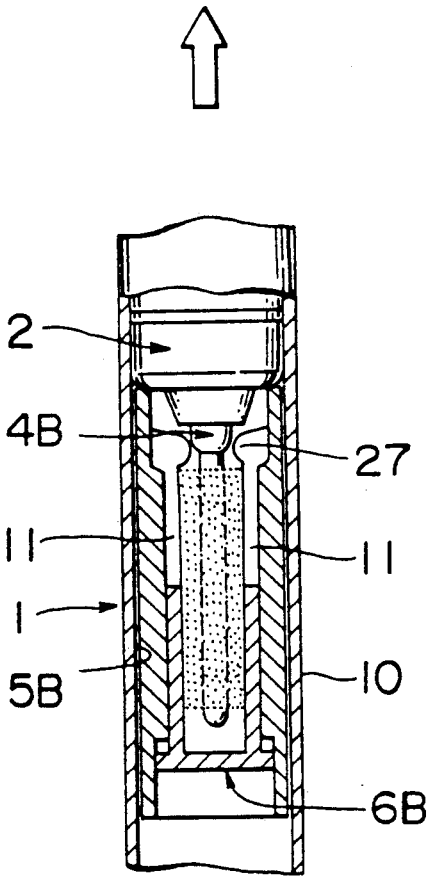

Third Embodiment (FIGS. 5 and 6)

In this embodiment, the gripper 6 is designed to grip the lower portion of the applicator shaft 4B immediately above the applicator 8B. To this end, the gripper 6 and the slider 5B are made to have somewhat elongated forms. The gripper 6B has a straight cylindrical form and upper half part of the gripper 6B is radially expandable. A plurality of inward engaging ridges 27 are provided on the expandable upper half part of the gripper 6B. These engaging ridges 27 are engageable with an engaging groove which is formed in the outer peripheral surface of the applicator shaft 4B near the lower end thereof. When the applicator 8B has been pulled upward, the expandable upper half part of the gripper 6B is allowed to expand so that the engaging ridges are disengaged from the engaging groove so as to relieve the applicator shaft 4B in a manner shown in FIG. 6.

In each of the embodiments described hereinbefore, the parts or components are molded from a synthetic resin unless otherwise specified, as in the cases of fourth to fourteenth embodiments which will be described later.

As has been described, in the third embodiment of the present invention, the slider 5B capable of scraping the inner surface of the barrel portion 10 of the container body and is made to grip a lower portion of the applicator shaft 4B through the intermediary of the gripper 6B which is radially expandable and which is received in the slider in radially contracted state. When the applicator is not used or when the scraping is conducted, the gripper 6B is received in the lower portion of the slider 5B so as to be held in radially contracted state. In the use of the applicator, the user pulls the applicator shaft 4B upward. The upward movement of the applicator shaft 4B after the slider 5B has reached the upper end of its stroke brings the gripper 6B into upper part of the slider 5B so as to allow the gripper 6B to radially expand, thus enabling the applicator shaft 4B to be pulled out of the container without difficulty, whereby the applicator 8B becomes ready to use with a very small pulling force.

Figure 8:
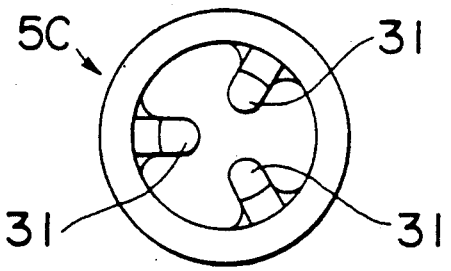
FIG. 8 is a top plan view of a slider incorporated in a fourth embodiment of the present invention.
Figure 7:
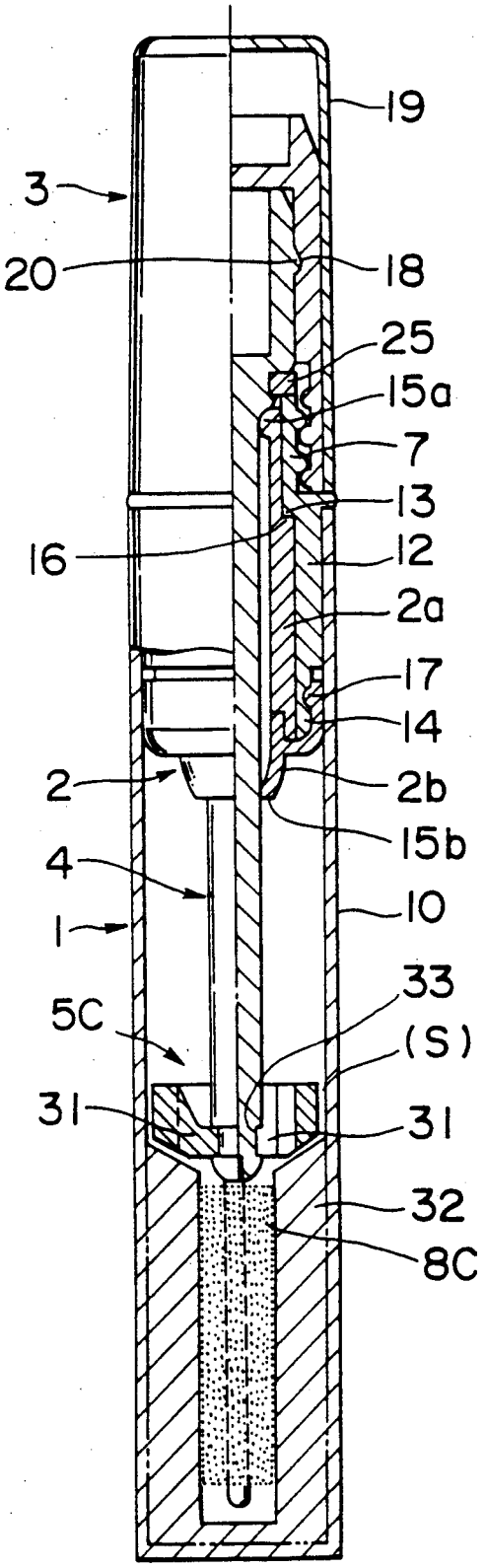
FIG. 7 is a vertical sectional view of a fourth embodiment of the present invention.
Figure 9:
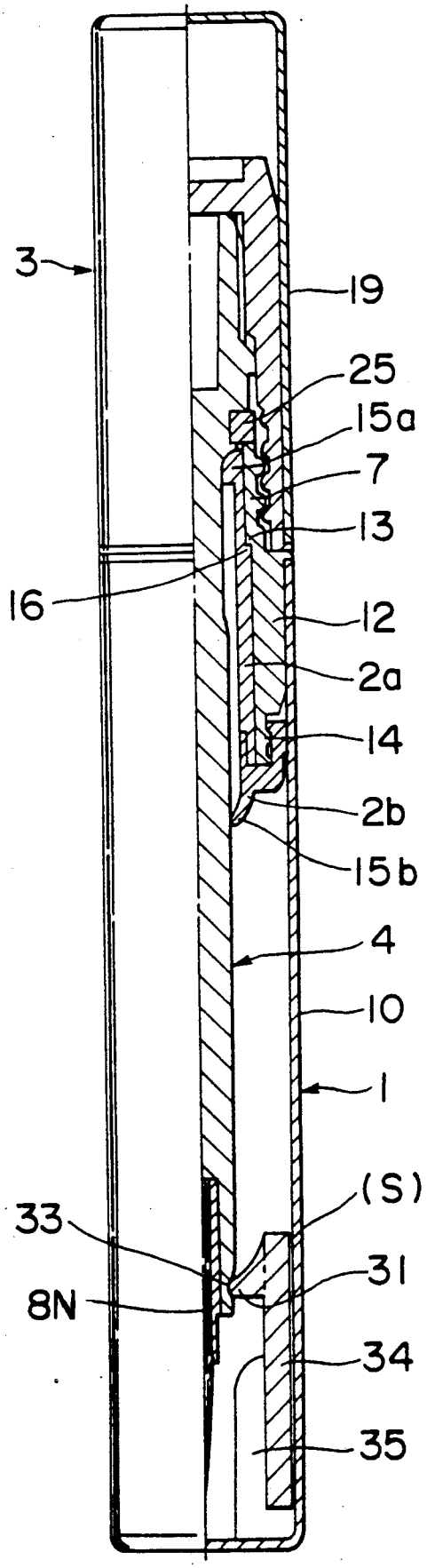
FIG. 9 is a vertical sectional view of a fifth embodiment of the present invention.

Fourth and fifth embodiments of the present invention will be described with reference to FIGS. 7 to 9.

Features common to the fourth and fifth embodiments will be described first. Each of the fourth end fifth embodiments has an elongated container body 1 containing a makeup liquid, a squeezing sleeve 2 fitted in the opening of the container body 1, a cap 3 screwed to the external surface of the neck portion 7 of the container body 1, an applicator shaft 4 extending downward from the cap 3 into the container body 1 through the squeezing sleeve 2, an applicator such as a brush attached to the lower end of the applicator shaft 4, and a slider having the form of a short cylinder and received in a barrel portion 10 of the container body 1 leaving a small gap S left therebetween, the slider having a plurality of projections 31 extending radially inwardly from the inner peripheral surface thereof at a plurality of points spaced in the circumferential direction so as to disengageably engage with a lower portion of the applicator shaft 4.

In use, the user unscrews the cap 3 and pulls the cap 3 upward so as to withdraw the applicator shaft 4. In this state, the applicator shaft 4 and the applicator are squeezed through the squeezing sleeve 2 so as to wipe the makeup liquid off the surface of the applicator shaft 4 and to squeeze the same off the applicator so as to enable the applicator to hold an optimum amount of the makeup liquid.

In this state, the slider does not make contact with the barrel portion 10 of the container body 1 but faces the inner surface of the barrel portion 10 such as to leave a narrow gap therebetween. The slider therefore can be lifted with a reduced force without encountering substantial frictional resistance.

Scraping is conducted during upward stroking of the slider. The upward movement of the slider is stopped due to contact with the squeezing sleeve 2 so that the applicator shaft 4 and, hence, the applicator can be taken out of the container, out of engagement with the slider. Disengagement of the slider from the applicator shaft 4 can be conducted without difficulty because the engagement between the slider and the applicator is achieved by means of a plurality of engaging projections 3 which are arranged in the circumferential direction of the slider.

The fourth embodiment will be described with reference to FIGS. 7 and 8. This embodiment is characterized in that the slider 5C is received in the barrel portion 10 of the container body 1 such as to leave a narrow gap S between itself and the inner surface of the barrel portion 10 so as to reduce the force required for the scraping motion during lifting of the applicator 8C and, hence, that the slider 5C is secured to a lower portion of the applicator shaft 4 for easy disengagement therefrom.

The container body 1 has an elongated barrel portion 10, a mouth member 12 fitted to the upper end opening of the barrel portion 10 and having an opened neck portion 7, and a cup-shaped reduced diameter portion 32 fixed in the bottom of the barrel portion 10 and having an inside diameter which is so determined as to just receive the applicator 8C. It is possible to fully use the liquid in the container body 1 by virtue of the provision of the reduced-diameter member 32 which reduces the volume of the bottom portion of the space inside the container body 1. The barrel portion 10 is preferably made of a decorative metallic material. This, however, is only illustrative and the arrangement may be such that the barrel portion 10, the mouth member 12 and the reduced-diameter member 32 are integrally molded from a synthetic resin. The mouth member 12 is provided on upper part of inner peripheral surface thereof with a downwardly facing step 13, while the lower part is thin-walled so as to leave a gap between itself and the surface of the barrel portion 10. An engaging ridge 14 is provided on the lower part of the outer peripheral surface of the thin-walled portion.

The squeezing sleeve 2, cap 3 and the applicator shaft 4 are denoted by the same reference numerals as those in the first embodiment, and detailed description is omitted with these embodiments because they are materially the same as those of the first embodiment.

An engaging groove 33 is formed in the portion of the outer peripheral surface of the applicator shaft 4 immediately above the applicator 8C.

The slider 5C has three projections 31,31 and 31 which are arranged on a lower part of the inner peripheral surface of the short sleeve so as to project radially inwardly at a 120° interval. These engaging projections 31, 31 and 31 engage with the engaging groove 33 so that the slider 5C is disengageably secured to the lower portion of the applicator shaft 4. Each projection 31 has a rounded end to facilitate disengagement from the engaging groove 33. The slider 5C secured to the applicator shaft 4 is disposed such that a narrow gap S is formed between itself and the inner surface of the barrel portion 10. The size of the gap S is suitably adjusted in accordance with the viscosity of the makeup liquid.

When the user unscrews the cap 3 to extract the applicator 8C from the container, the slider 5C spirally moves upward as a unit with the applicator shaft 4 so as to materially scrape any makeup liquid off the inner surface of the barrel portion 10. The slider 5C contacts, when moved to the upper end of its stroke, the squeezing sleeve 2 so as to be stopped. Therefore, a further upward pulling of the applicator shaft 4, i.e., the applicator 8C, causes the engaging projections 3 to be disengaged from the engaging groove 33. The disengagement of the engaging projections 31 from the engaging groove 33 is conducted without difficulty partly because the ends of the engaging projections 31 are rounded and partly because the engagement is achieved not over the entire circumference but for only three portions which are spaced in the circumferential direction. A reference numeral 25 denotes a packing.

The fifth embodiment of the invention will be described with reference to FIG. 9. In contrast to the slider of the fourth embodiment having a short cylindrical member provided with three engaging projections 31 formed on the inner peripheral surface thereof, this embodiment incorporates a slider composed of a long cylindrical member 34 which is provided at its upper portion with three engaging projections 31 extending from the inner peripheral surface thereof. In this case, a cap S is formed between the long cylindrical member 34 and the inner surface of the barrel portion 10 of the container body 1. It is also to be pointed out that the reduced-diameter member 32 used in the fourth embodiment is substituted by a fitting cylinder 35 seated on the bottom of the container body 1 such that the lower half part of the long cylindrical member 34 of the slider fits around the fitting member 35. A brush is used as the applicator 8N. Constructions of other portions, as well as operation and effect, are materially the same as those shown in FIGS. 7 and 8.

Thus, in the fourth and fifth embodiments of the present invention, the slider is received in the barrel portion 10 of the container body 1 such that a small gap is formed between itself and the inner peripheral surface of the barrel portion 10. In consequence, the frictional resistance during movement of the applicator shaft 4 and the slider is reduced so that the scraping operation during upward sliding of the applicator can be conducted with a reduced force. This advantage is obtainable without substantially impairing the scraping effect. In addition, the disengagement of the applicator shaft 4 from the slider can be affected with a small force because the engagement between the applicator shaft 4 and the slider is attained only at several points which are spaced in the circumferential direction, in contrast to an arrangement in which the slider engages the applicator shaft 4 over the entire periphery thereof by means of a peripheral engaging ridge.

Sixth and seventh embodiments of the present invention will be described with reference to FIGS. 10 to 14.

The sixth and seventh embodiments have the following features. Namely, the makeup liquid container comprises: an elongated container body 1 containing a makeup liquid, a squeezing cylinder fixedly fitted in an opening of the container body 1, a cap 3 screwed to the outer surface of the open neck portion 7 of the container body 1, an applicator fixed to the cap 3 and extending downward therefrom into the container body 1 through the squeezing sleeve 2, an applicator fixed to a lower portion of the applicator shaft 4, and a cylindrical slider received in the barrel portion 10 of the container body 1 such that a narrow gap S is formed between itself and the inner surface of the barrel portion 10, the slider being fitted around the applicator shaft 4 or the applicator somewhat tightly but disengageably.

In use, the user unscrews the cap 3 from the open neck portion 7 so as to pull the applicator shaft 4 integral with the cap 3 off the container body 1. During extraction of the applicator shaft, the applicator shaft 4 and the applicator are made to pass through the squeezing cylinder 2 so that makeup liquid on the surface of the applicator shaft 4 is wiped off and the applicator is squeezed to remove any excessive makeup liquid, thus optimizing the amount of the makeup liquid held by the applicator.

Since the slider is received in the barrel portion 10 of the container body 1 leaving a narrow gap therebetween, the lifting of the slider and, hence, of the applicator shaft 4 can be conducted by a small force without encountering any substantial frictional resistance. Nevertheless, scraping is conducted materially so as to effectively scrape the makeup liquid off the inner surface of the barrel portion 10 of the container body 1, while effectively agitating the makeup liquid.

When the slider has reached the upper end of its stroke, it abuts the squeezing sleeve 2 so as to be stopped. A further upward movement of the applicator shaft 4 therefore causes the applicator to come off the slider. The disconnection of the applicator from the slider can be accomplished simply and easily because the slider fits around the applicator rather tightly but disengageably. Therefore, the applicator shaft 4 and, hence, the applicator can easily be extracted from the container body, thus affording an easy application of the makeup liquid.

The sixth and seventh embodiments will be described in more detail with reference to the drawings. As explained before, these embodiments have a feature that the slider is secured to the surface of a lower portion of the applicator shaft 4 or of the applicator somewhat tightly but disengageably so as to enable the slider to come off the applicator shaft 4 or the applicator rather easily.

Figure 10:
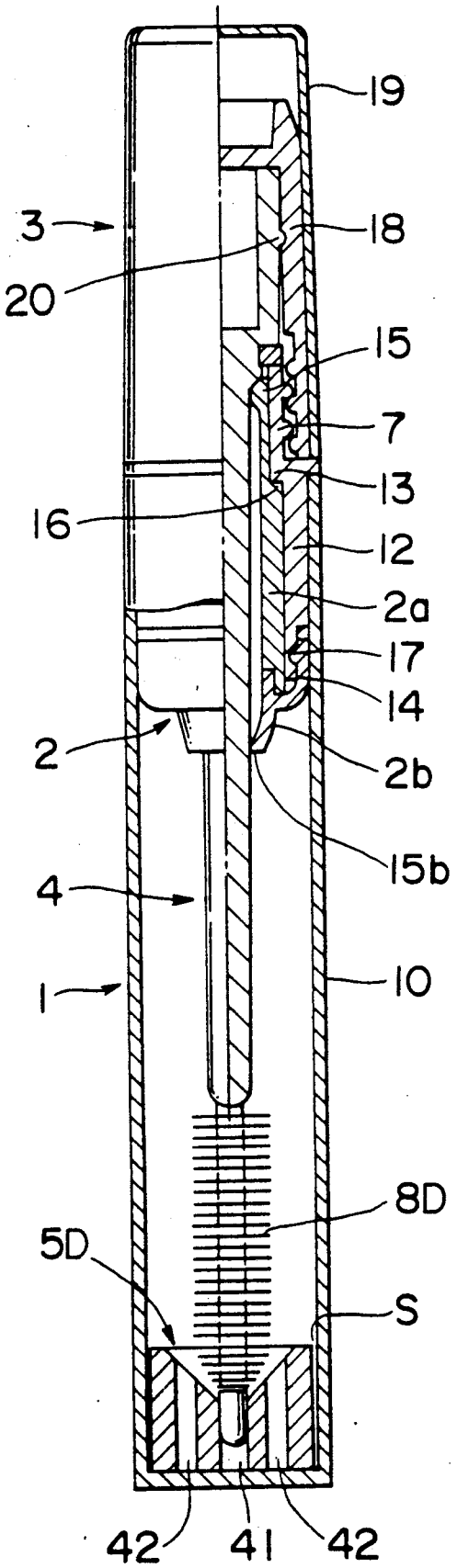
FIG. 10 is a vertical sectional view of a sixth embodiment of the present invention.
Figure 11A:
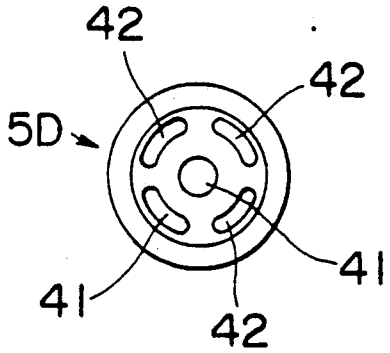
FIGS. 11(*a*) and 11(*b*) are a top plan view and a partly-sectioned front elevational view of a slider incorporated in the sixth embodiment.
Figure 11B:
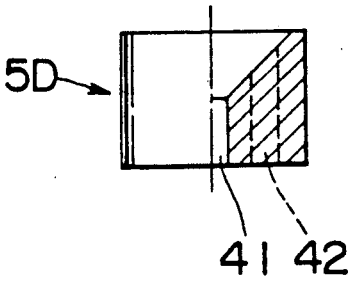

Sixth Embodiment (FIGS. 10, 11(*a*), 11(*b*))

The container body 1, squeezing sleeve 2, cap 3 and the applicator shaft 4 of this embodiment are materially the same as those in the first embodiment so that these components are denoted by the same reference numerals as those in the first embodiment and detailed description of such components is omitted.

The slider 5D has a short cylindrical member with a concaved top surface. This short cylindrical member is provided with a central mounting hole and a plurality of apertures 42 disposed around the central hole and extending vertically through the cylindrical member such as to serve as passages for the liquid. This slider 5D is fitted around the outer surface of the lower end of the applicator shaft 4 immediately below the applicator 8D somewhat tightly but disengageably. Actually, however, the engagement between the applicator shaft 4 and the slider 5D is accomplished by forcibly inserting the applicator shaft 4 into the central bore 41 of the slider 5D. The slider 5D, thus attached to the applicator shaft 4, is placed in the barrel portion 10 of the container body 1 in such a manner that a small gap S is left between the inner surface of the barrel portion 10 and the slider 5D. The size of the gap S is so determined that the slider 5D can materially perform scraping of the makeup liquid on the inner surface of the barrel portion 10.

The provision of the small gap S between the slider 5D and the inner surface of the barrel portion 10 enables the slider 5D to slide and scrape with a small force applied to the applicator shaft 4, so that the strength of the temporary connection between the slider 5D and the applicator shaft 4 need not be large. This in turn enables the applicator shaft 4 to be disengaged from the squeezing sleeve 2 with a small force when the slider 5D is brought into contact with the squeezing sleeve 2 at the upper end of its stroke.

Figure 12:
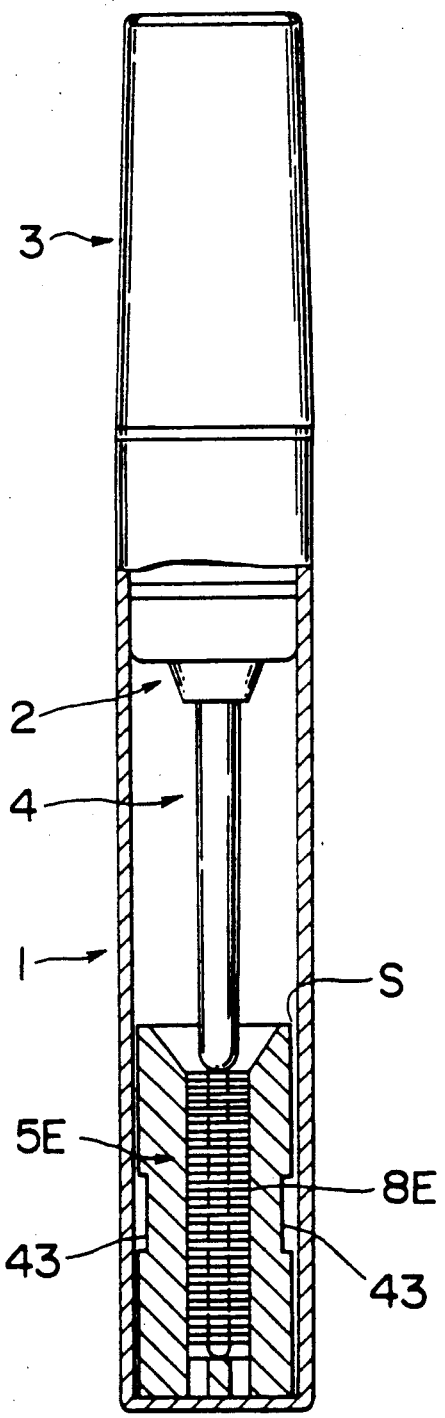
FIG. 12 is a vertical sectional front elevational view of a seventh embodiment of the present invention.
Figure 13:
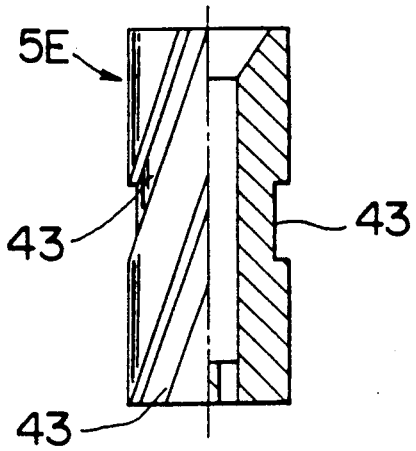
FIG. 13 is a partly-sectioned front elevational view of a slider incorporated in the seventh embodiment.
Figure 14:
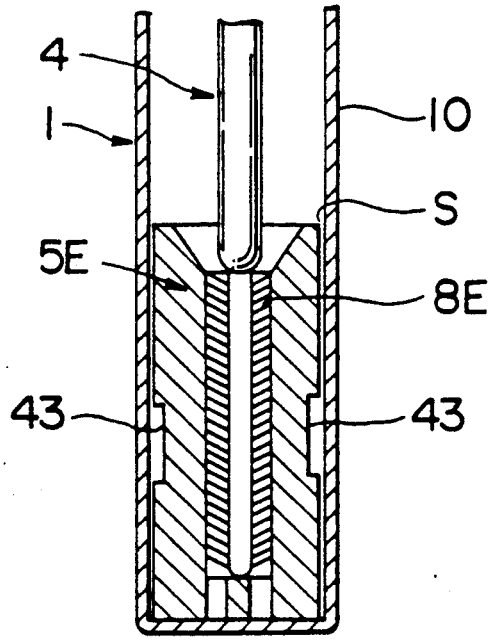
FIG. 14 is a partly-sectioned front elevational view of a modification of the arrangement of FIG. 13, having a greater strength of bonding between the brush and the slider.

Seventh Embodiment (FIGS. 12, 13 and 14)

This embodiment employs a slider 5E which is composed of an elongated cylindrical member having a central bore the inside diameter of which is smaller than the outside diameter of the applicator 8E which is typically a brush in this case. The applicator 8E is forced into the central bore of the slider 5E so that the slider 5 is disengageably connected to applicator shaft 4. Thus, the engagement between the applicator shaft 4 and the slider 5E is attained by making an effective use of the stiffness of the pipe of the applicator such as a brush. FIG. 14 shows a case where the slider is fitted on the applicator 8E more tightly than in the arrangement shown in FIG. 12. The slider 5E is provided in the outer peripheral surface of the slider 5E with a plurality of slant grooves 43 which also serve as liquid passages.

In each of the sixth and seventh embodiments, the slider is stationed at the bottom of the barrel portion 10 of the container body 1 when the applicator is not used. Therefore, the volume of the dead space at the bottom of the container body is decreased so as to reduce the amount of the makeup liquid which wastefully remains in the bottom of the container.

Figure 15:
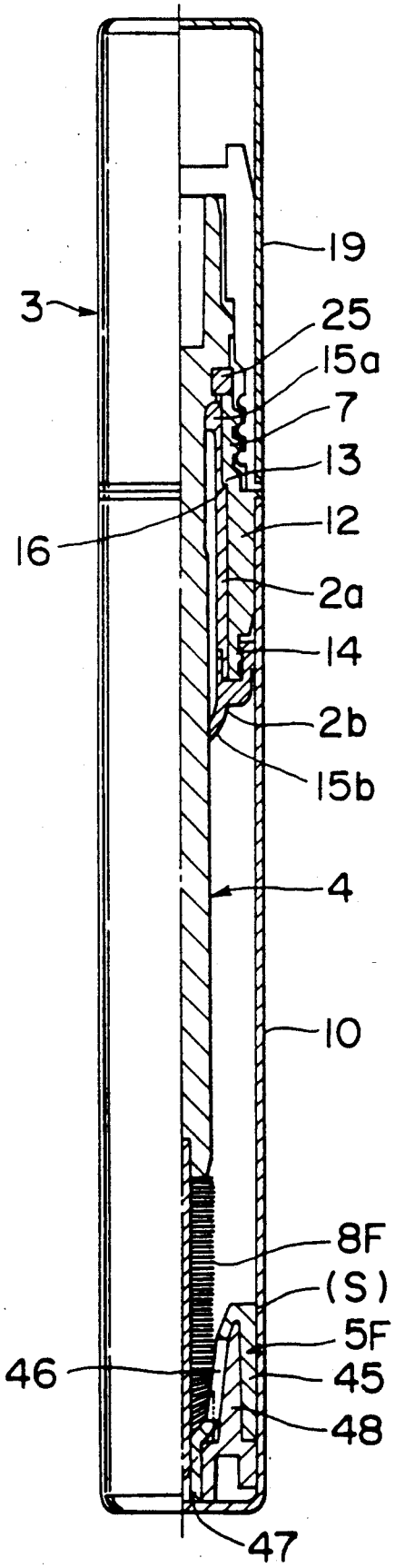
FIG. 15 is an illustration of an eighth embodiment of the present invention.
Figure 16A:
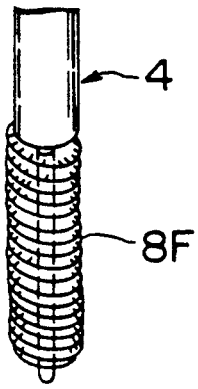
FIGS. 16(*a*), 16(*b*) and 16(*c*) are perspective views of an applicator shaft, a slider and a sleeve incorporated in the eighth embodiment.
Figure 16B:
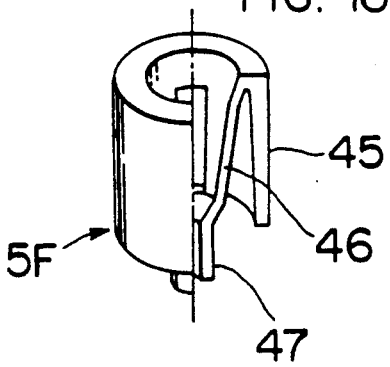
Figure 16C:
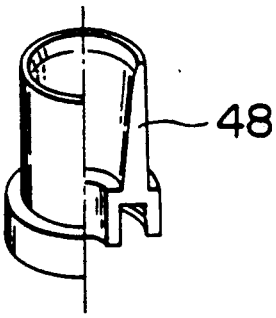

Eighth Embodiment (FIG. 15 and FIGS. 16(*a*), 16(*b*) and 16(*c*))

An eighth embodiment of the present invention will be described with specific reference to FIGS. 15 and 16(*a*) to 16(*c*).

This embodiment has a slider 5F which is composed of a tubular member 45, a plurality of support legs 46 extending downward and inward from an upper portion of the tubular member 45, and engaging cylinder segments 47 formed on the lower ends of the support legs 46, the engaging cylinder segments 47 in cooperation forming a partial cylinder which can somewhat tightly but disengageably hold the end of the applicator shaft 24. The space defined by the support legs 46 has an inverse frusto-conical tapered form which has a larger-diameter upper end having a diameter greater than the outside diameter of the applicator 8F and a smaller-diameter lower end portion having a diameter smaller than the outside diameter of the applicator 8F. As in the cases of some preceding embodiments, a gap S is left between the inner peripheral surface of the barrel portion 10 of the container body and the tubular member 45 of the slider 5F. A fitting sleeve 48 seated on the bottom of the container body 1 is adapted to be received in the space between the tubular member 45 of the slider 5F and the support legs 46 from the lower side of this space. Constructions of other portions, as well as operation and effect, are materially the same as those in the embodiment shown in FIG. 10.

Ninth, tenth and eleventh embodiments of the present invention will be described with reference to FIG. 17(*a*) to FIG. 20(*b*).

The ninth to eleventh embodiments have the following common features. Namely, the makeup liquid container has an elongated container body 1 containing a makeup liquid, a squeezing sleeve 2 fixed in an open neck 7 of the container body 1, a slider vertically movably received in the container body 1 and having a slider ring which slidably contacts the inner peripheral surface of the barrel portion 10 of the container body 10, a cap 3 screwed to the outer surface of the neck 7, an applicator shaft 4 fixed at its one end to the cap 3 so as to extend downward therefrom into the container body 1 through the squeezing cylinder 2,the other end of the applicator shaft 4 disengageably engaging with the slider so as to move the slider up and down as when driven out of and into the container body. 1, and an applicator such as a brush secured to the extreme end of the applicator shaft 4.

In use of the applicator, the user unscrews the cap 3 to lift it from the open neck 7 of the container body 1 and pulls the cap 3 together with the applicator shaft 4 so as to extract the latter from the container body 1. During the extracting operation, the applicator shaft 4 and the applicator are made to forcibly move through the squeezing sleeve 2 so that the squeezing sleeve 2 effectively wipes the makeup liquid off the surface of the applicator shaft 4 and squeezes any excessive makeup liquid from the applicator so as to optimize the amount of the makeup liquid held by the applicator.

Since the applicator shaft 4 disengageably engages with the slider, the slider moves upward when the applicator shaft 4 is extracted so that the slider ring slides along the inner peripheral surface of the container body 1 thereby scraping makeup liquid off the inner peripheral surface of the barrel portion 10 of the container body 1.

When the slider has reached the upper end of its stroke which is set at an upper portion of the barrel portion 10 of the container body 1, any further movement of the slider is prevented so that a further outward movement of the applicator shaft 4 causes the applicator shaft 4 to be disengaged from the slider, whereby the applicator shaft 4 with the applicator can be withdrawn from the container body while leaving the slider inside the container body 1. After use, the user inserts the applicator shaft 4 with the applicator into the container body 1, so that the applicator shaft 4 is brought into engagement with the slider again.

Figure 17A:
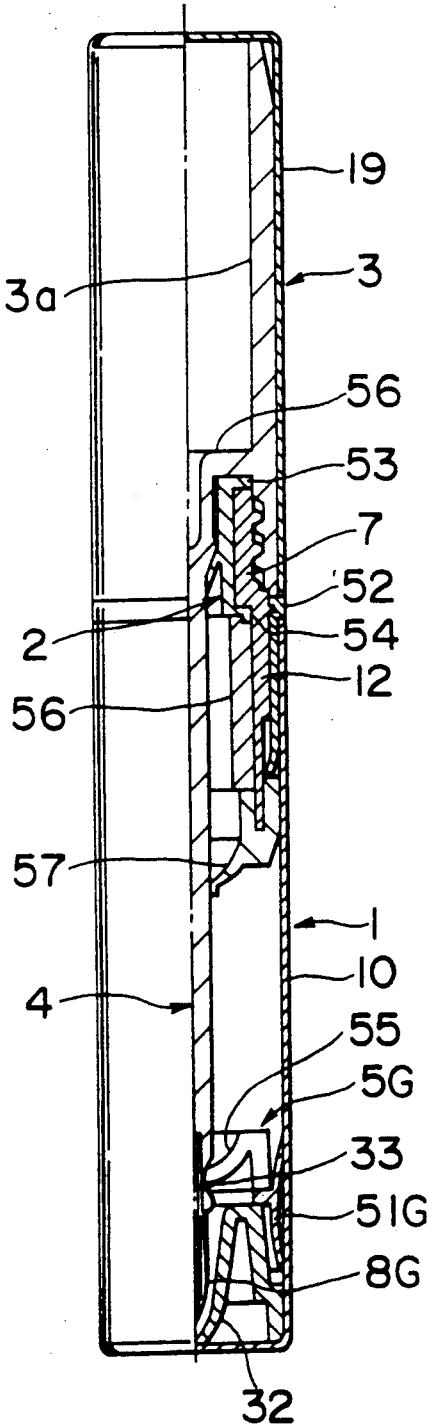
FIG. 17(*a*) is a partly-sectioned vertical sectional view of a ninth embodiment.
Figure 17B:
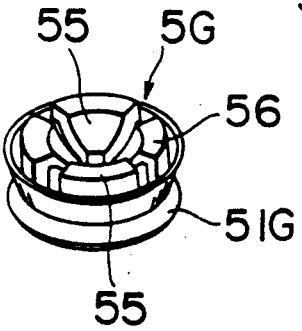
Figure 18:
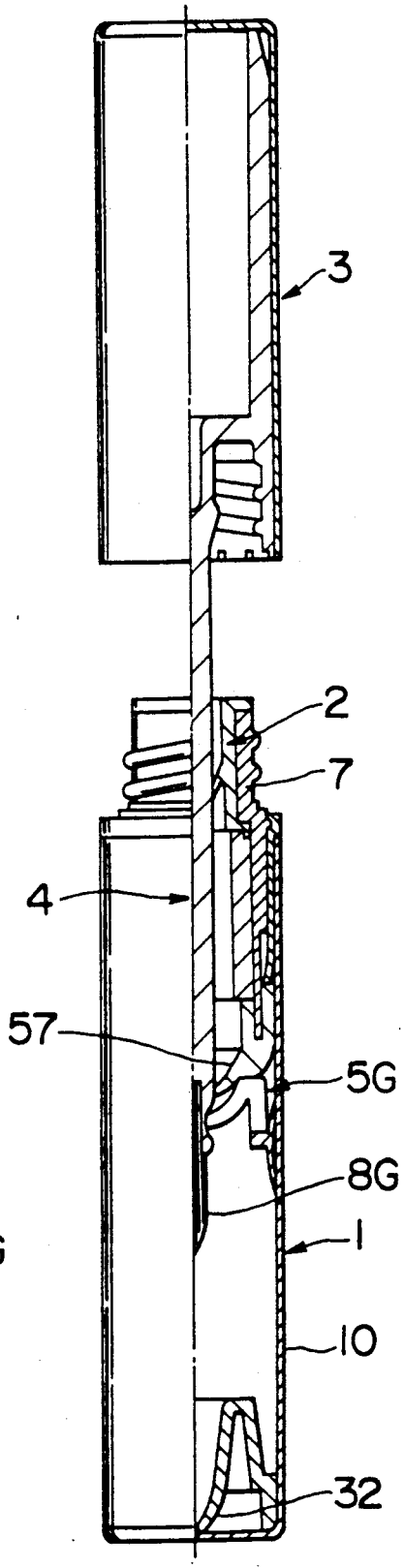
FIG. 18 is a partly-sectioned elevational view of the ninth embodiment with a brush shaft lifted.

Ninth Embodiment (FIGS. 17(*a*), 17(*b*) and 18)

The container body 1 has a barrel portion 10 made from a decorative metallic material. A tubular metallic intermediate member 52 is fixed in an upper portion of the barrel portion 10. A mouth member 12 with a neck 7 having an external screw thread is fitted in the intermediate member 52. A bottom space restricting member 32 is frictionally fitted in the bottom of the barrel portion 10 in such a manner as to restrict the bottom space in conformity with the shape of the applicator 8G. The provision of the bottom space restricting member decreases the amount of makeup liquid which wastefully remains in the container body without being used.

The squeezing sleeve 2 is made of a soft elastic material such as a rubber or a soft synthetic resin. The squeezing sleeve 2 is provided at its upper and lower ends with outwardly extending flanges 53, 54 which cooperate with each other in clamping therebetween the neck 3 in contact with the upper and lower surfaces of the neck 7, so as to be fixed in the neck 7. A restricted opening is formed by an annular ridge which projects radially inward from the inner peripheral surface of the squeezing cylinder 2 at an axially mid portion thereof so as to resiliently contact the outer surface of the applicator shaft 4.

As generally shown in FIG. 17(*b*), the slider 5 has a slider ring 51 which resiliently contacts the inner surface of the barrel portion 10. The slider ring 51G has a plurality of resilient inverse V-shaped engaging tabs 55 projecting radially inwardly from the inner peripheral surface thereof and arranged in the circumferential direction at a suitable interval. In the illustrated case, the slider ring 51 has four such engaging tabs. These engaging taps cooperate with one another in defining, at their free ends, a substantially cylindrical space.

The cap 3 has a tubular member 3*a* having a screw thread formed in upper portion of the inner peripheral surface thereof and a decorative coating member 19 which coats the tubular member 3*a*.

The applicator shaft 4 has an outwardly extending flange formed on the upper end thereof integrally with the tubular member 3*a* of the cap 3. An applicator 8G is attached to the lower end of the applicator shaft 5G such as to be received in the bottom-space restricting member 32. An engaging recess 33 is formed in the surface of the applicator shaft 4 at a portion thereof immediately above the applicator 8G. The free ends of the engaging tabs 55 of the slider 5G engage with this engaging recess 33.

A reference numeral 56 denotes an intermediate member, while 57 designates a second squeezing sleeve serving also as a buffer member. The second squeezing cylinder 57 clamps the lower portion of the mouth member 12 and is frictionally fixed in the barrel portion 10.

Figure 19A:
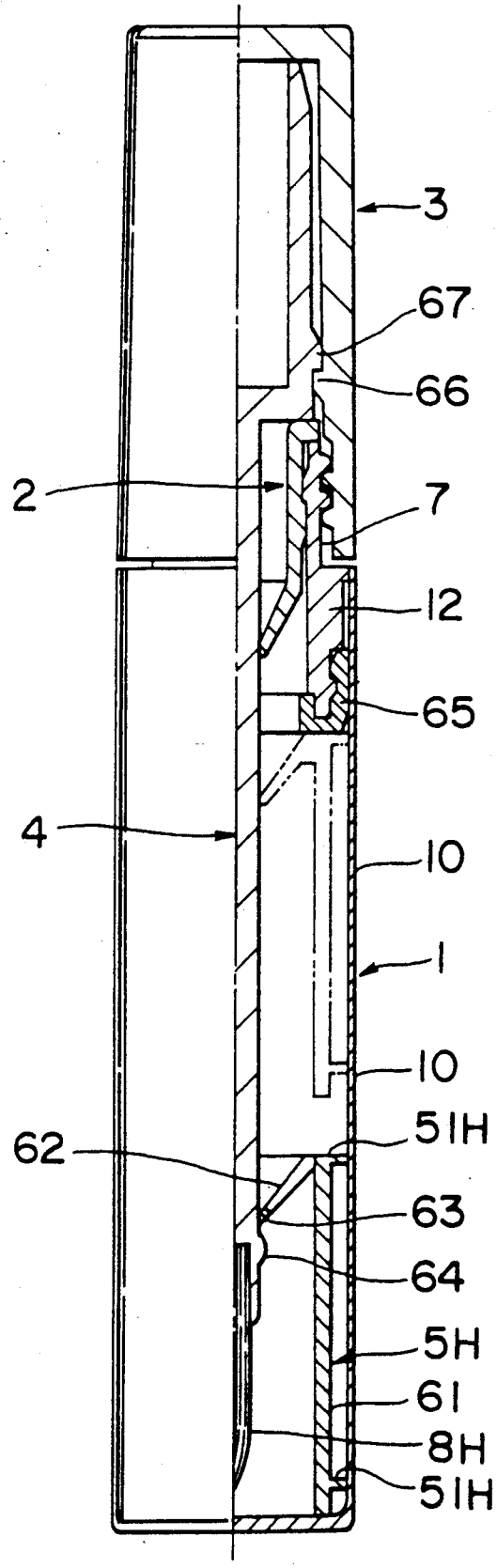
FIG. 19(*a*) is a partly-sectioned elevational view of a tenth embodiment.
Figure 19B:
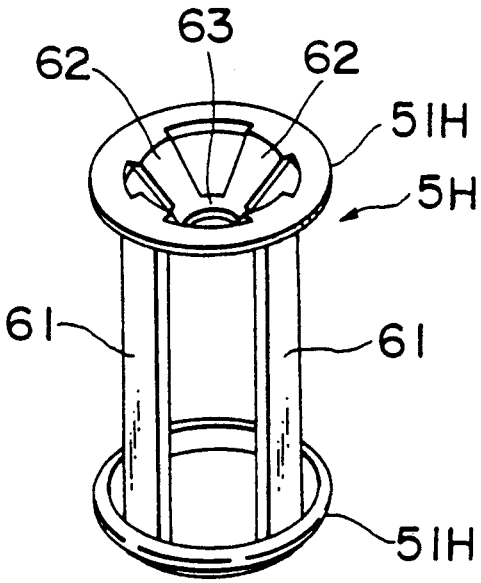

Tenth Embodiment (FIGS. 19(*a*), 19(*b*))

This embodiment employs a slider 5H with slider rings 51H,51H provided on upper and lower portions thereof. The slider rings 51H and 51H are connected through a plurality of connecting plates 61 which are arranged at a suitable circumferential pitch. A plurality of support members 62 extend obliquely downward from the upper slider ring 51H at a suitable circumferential pitch. The lower ends of the support members 61 form a ring 63 capable of loosely receiving the applicator shaft 4. On the other hand, the applicator shaft 4 has a peripheral ridge 64 which is engageable with the slider 5H so as to lift the slider 5H. The thickness of the support members 62 is reduced at portions adjacent to the free ends thereof so as to impart resiliency to the ring portion 63. A reference numeral 65 designates a sealing member which also serve as a buffer.

Figure 20A:
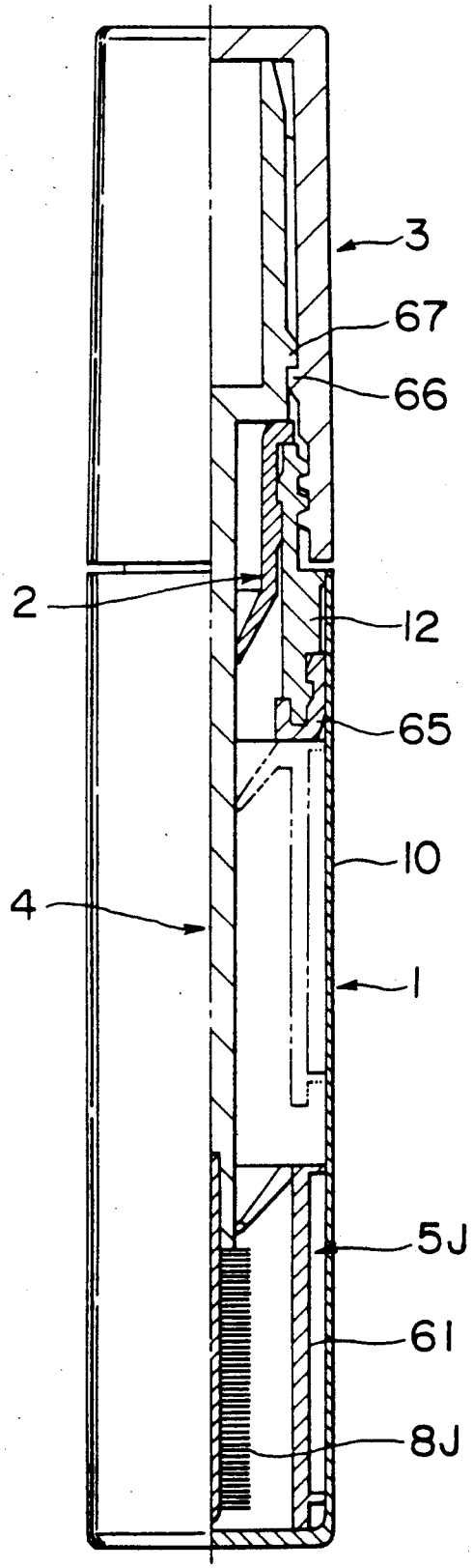
FIG. 20(*a*) is a partly-sectioned elevational view of an eleventh embodiment of the present invention.
Figure 20B:
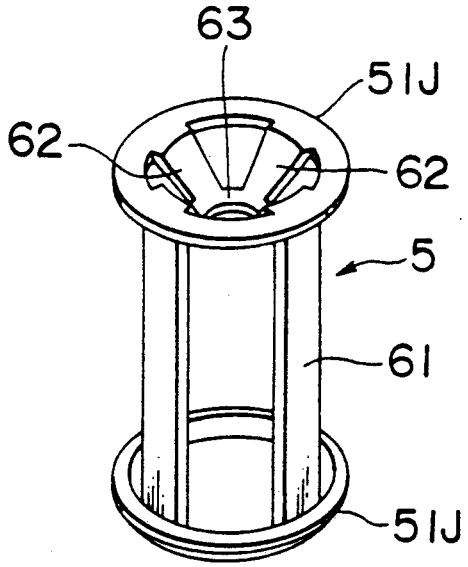

Eleventh Embodiment (FIGS. 20(*a*) and 20(*b*))

This embodiment employs a mascara brush as the applicator 8J. Since the piles of brush are rather stiff, the brush itself can engage with the slider 5J with a tightness which is large enough to cause the slider 5J to move up and down. This embodiment, therefore, does not employ engaging means such as a ridge 64 provided on the applicator shaft in some of the preceding embodiments.

In the tenth and eleventh embodiments, the bottom-space restricting member 32, metallic cap and the second squeezing cylinder 57 are omitted. At the same time, the cap 3 and the applicator shaft 4 are constructed as separate members and are held together through engagement at their engaging ridges 66 and 67.

Thus, in the tenth and eleventh embodiments of the present invention, a slider is received in the container body 1 such that it can move up and down in sliding contact with the inner surface of the barrel portion 10 of the container body 10, and the slider is disengageably connected to the applicator shaft 4 such as to be moved up and down as the applicator shaft is withdrawn from and inserted into the container body 10 thereby to scrape makeup liquid off the inner surface of the barrel portion 10 of the container body 1. This arrangement is obtained simply by setting the slider in the container body 1.

Twelfth and thirteenth embodiments of the present invention will be described with reference to FIGS. 21 through 24.

These embodiments have a common feature in that the makeup liquid container comprises an elongated container body 1 containing a makeup liquid, a squeezing sleeve 2 fixed in an open neck 7 of the container body 1, a vertically movable slider received in the container body 1 and having an annular claw 71 which slidingly contacts the inner surface of a barrel portion 10 of the container body 1, the slider being urged upward by a reset spring 72, a cap 3 screwed to the outer surface of the open neck 7 of the container body 1, an applicator shaft 4 fixed to the cap 3 and extending downward into the container body 1 through the squeezing sleeve 2 and adapted to move the slider downward when inserted into the container body l, and an applicator fixed to the end of the applicator shaft remote from the cap 3.

In use, the user unscrews the cap 3 from the open neck 7 and pulls the same so as to extract the applicator shaft 4 integral with the cap 3. During the pulling, the applicator shaft 4 and the applicator are made to move through the squeezing sleeve 2 so that makeup liquid is scraped off the applicator shaft 4 and the applicator is squeezed to optimize the amount of the makeup liquid held by the applicator.

The slider is biased downward by the applicator shaft 4 whenever the applicator shaft 4 is received in the container 1. However, as the applicator shaft 4 is withdrawn from the container body 1, the slider is released so that it is moved upward by the force of the reset spring 72. During the upward movement of the slider, the annular claw 71 slides along the inner surface of the barrel portion 10 of the container body 1 so as to scrape makeup liquid off the inner surface of the barrel portion 10.

Figure 21:
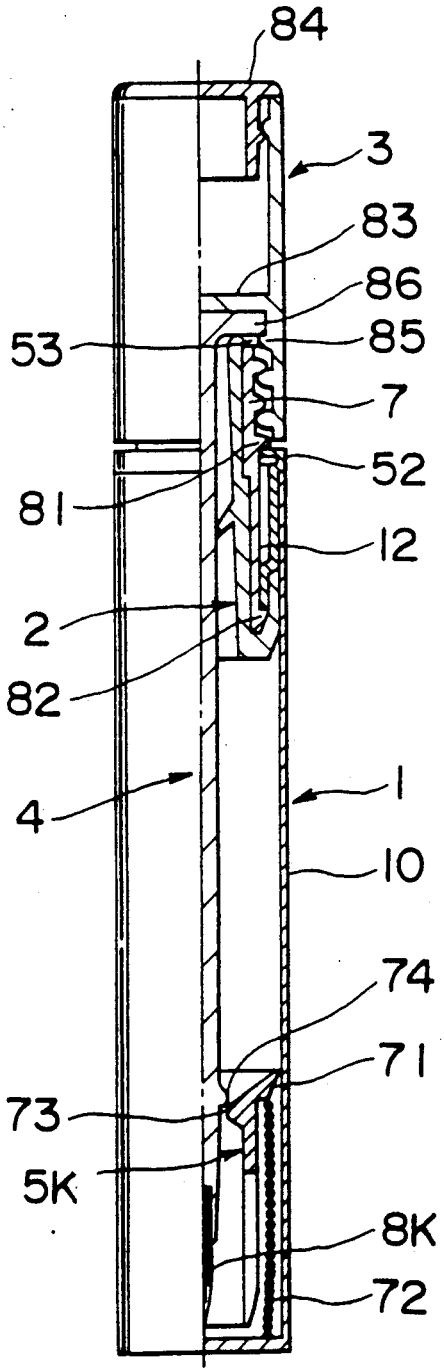
FIG. 21 is a partly-sectioned elevational view of a twelfth embodiment of the present invention.
Figure 22:
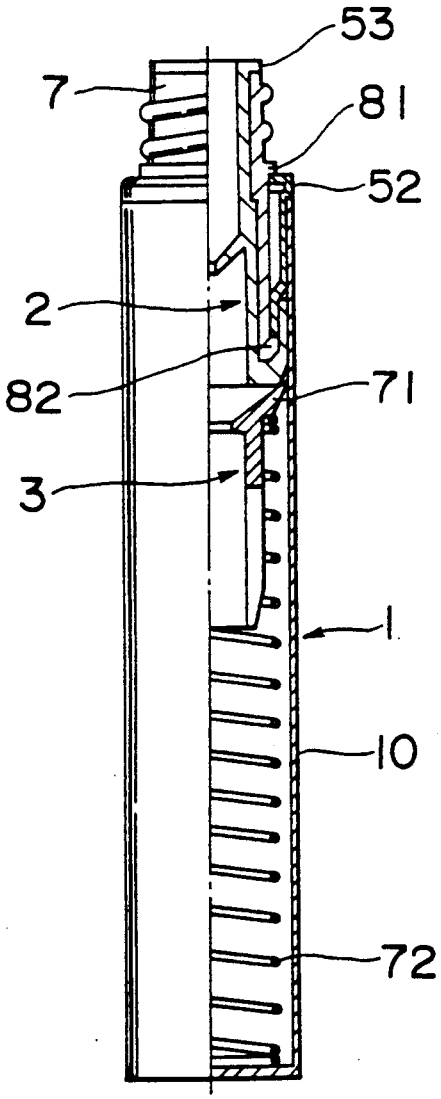
FIG. 22 is a partly-sectioned elevational view of a container body of the twelfth embodiment with a cap and a brush shaft withdrawn therefrom.

The twelfth embodiment will be described in more detail with reference to FIGS. 21 and 22.

The twelfth embodiment has an elongated container body 1. An intermediate metallic member 52 with a reduced-diameter lower end portion is fitted in the upper end of the barrel portion 10. A mouth member 12 with an open neck 7 has engaging ridges 81 and 82 which are provided on the outer surface of an intermediate portion thereof and on the outer surface of the lower end portion thereof. These engaging ridges 81 and 82 engage with the upper end and lower end surfaces of the intermediate metallic member 52 so as to clamp the intermediate metallic member 52, whereby the mouth member is fixed in the container body 1. The barrel portion 10 also may be made from a decorative metallic material. The open neck 7 is threaded at its outer surface.

The squeezing sleeve 2 is made from a soft elastic material such as a rubber or a soft synthetic resin, and is provided at its upper end with an outwardly extending flange 53 which is adapted to rest on the top of the open neck 7, while the lower end of the squeezing sleeve 2 is turned outward so as to provide a U-shaped cross-section. The squeezing sleeve 2 is attached to the container body 1 with both walls of the U-sectioned lower end thereof embracing the lower ends of the mouth member 12 and the intermediate metallic member 12. A restricted opening is formed in an intermediate portion of the squeezing sleeve 52 such that the wall defining this restricted opening can make resilient pressure contact with the applicator shaft 4 which extends through this opening. The U-shaped lower end of the squeezing sleeve 2 serves as a buffer member.

The slider 5K is a cylindrical member which is provided with a plurality of slits formed in a lower portion thereof at a predetermined circumferential interval. The slider 5K is provided with an annular claw 71 which extends from the outer periphery of the upper end thereof in such a manner as to make sliding contact with the inner surface of the barrel portion 10 of the container body 1. A protrusion or ridge 73 projects from the inner surface of the slider 5K. The slider 5K is set in the container body 1 while being urged upward by a coiled reset spring 72.

The cap 3 is provided at an intermediate portion thereof with a partition plate 83 and is threaded at its inner peripheral surface below the partition plate 83. The upper end opening of the cap 3 is closed by a decorative cover 84 which is fitted therein. An engaging projection 85 is formed to project from the inner surface of the cap 3 immediately below the partition plate 83.

The applicator shaft 4 is provided at its upper end with a mounting plate 86 which is fitted in an engaging recess defined between the engaging ridge 85 and the partition plate 86, whereby the applicator shaft 5K is secured to the cap 3. When the cap 3 is properly set on the open neck 7 of the container body 1, the applicator shaft 4 extends downward into the container body 1. An applicator 8K such as a makeup brush is fixed to the lower end of the applicator shaft 4. A flange 74 is formed on a lower portion of the applicator shaft 4. The flange 74 is capable of pressing the slider 5K downward against the force of the reset spring 72 when the applicator shaft 4 is inserted into the container body 1. Thus, after the applicator shaft 4 has been fully inserted into the container body 1, the flange 74 holds the slider 5K in the depressed position against the force of the reset spring 72.

Figure 23:
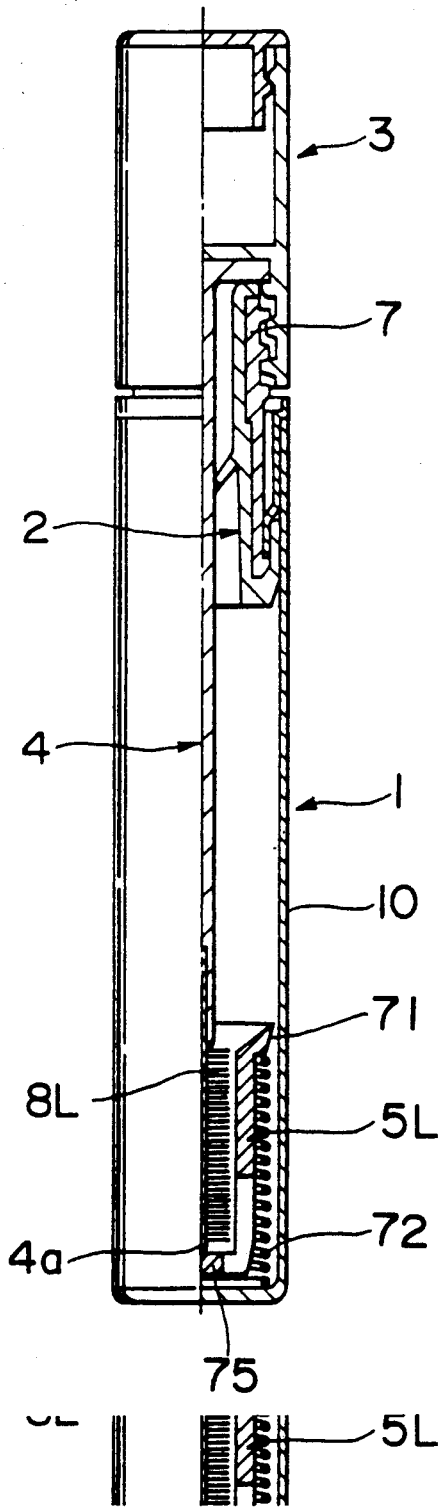
FIGS. 23 and 24 are illustrations of a thirteenth embodiment, corresponding to FIGS. 21 and 22, respectively.
Figure 24:
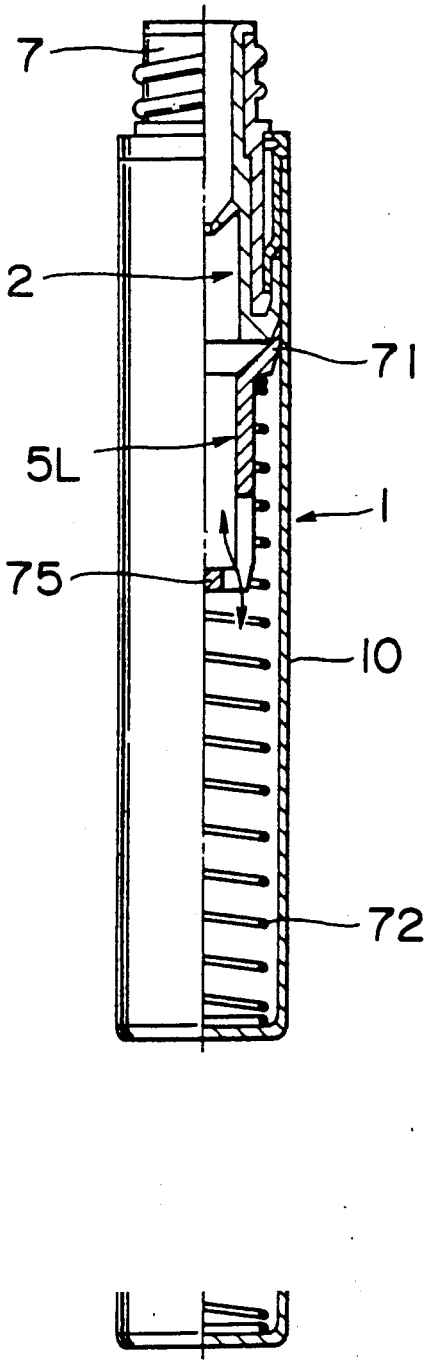

The thirteenth embodiment will now be described with specific reference to FIGS. 23 and 24. In this embodiment, the slider 5L is provided with a bottom plate 75. On the other hand, the applicator shaft 4 has a lower end **4*a* below the applicator 8L. The lower end 4*a* is adapted to be pressed against the bottom plate 75 of the slider 5L so as to press the slider 5L downward. This arrangement offers an advantage in that a troublesome work enabling the hard large-diameter flange 74 to clear the restricted opening in the squeezing sleeve 2. The makeup liquid is allowed to flow through slits formed in the lower half part of the slider 5L** as indicated by arrows.

Thus, in the twelfth and thirteenth embodiments of the present invention, the slider is received in the container body 1 for vertical movement in sliding contact with the inner surface of the container body 1 and is urged upward by the reset spring 72. When the applicator shaft 4 is inserted into the container body 1, the applicator shaft 4 presses the slider downward, whereas, when the applicator shaft 4 is withdrawn from the container body 1, the slider is moved upward by the force of the reset spring 72 so that the scraping of makeup liquid attaching to the inner surface of the container body 1 is effected upon each insertion and each withdrawal of the applicator shaft 4.

Figure 25:
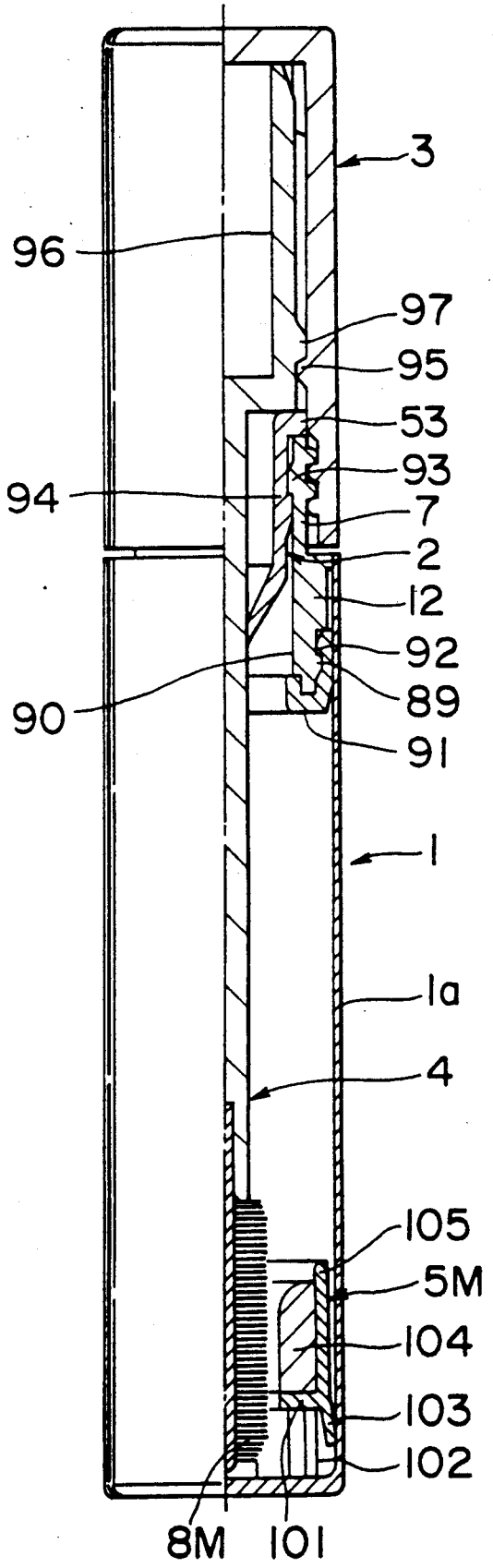
FIG. 25 is a partly-sectioned elevational view of a fourteenth embodiment of the present invention.
Figure 26:
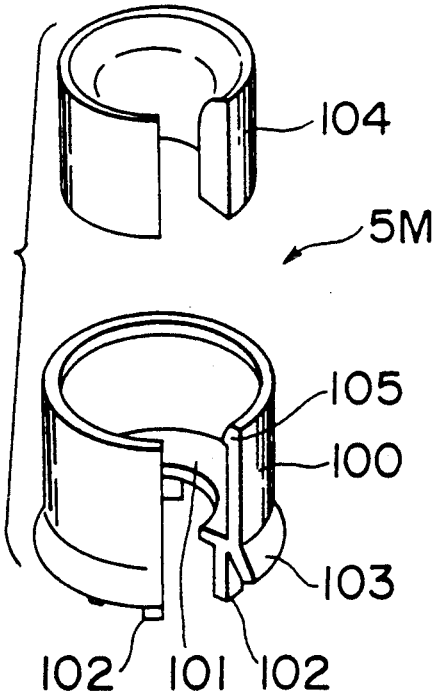
FIG. 26 is an exploded perspective view of a slider incorporated in the fourteenth embodiment.

Fourteenth Embodiment (FIGS. 25 and 26)

Finally, a fourteenth embodiment of the present invention will be described with reference to FIGS. 25 and 26. This embodiment is characterized in that the slider is made to slide along the inner surface of the container body as the container body is shaken.

The makeup liquid container with applicator in accordance with this embodiment has an elongated container body 1 containing a makeup liquid, a squeezing sleeve 2 fixed in the open neck 7 of the container body 1, a cap 3 screwed to the outer surface of the open neck 7, an applicator shaft fixed at its one end to the cap 3 and extending downward into the container body through the squeezing sleeve 2, an applicator such as a brush fixed to the other end of the applicator shaft 4, and a slider 5M received in the container body 1 in slight pressure contact with the inner surface of the container body 1 and is movable along the inner surface of the container body 1 up and down when the container body 1 is shaken, thereby scraping makeup liquid off the inner surface of the container body 1.

In use, the user unscrews the cap from the open neck 7 of the container body 1 and pulls the cap 3 together with the applicator-shaft 4 integral with the cap 3. During the pulling, the applicator shaft 4 and the applicator 8M are forcibly made to pass through the squeezing sleeve 2 so as to scrape any makeup liquid off the surface of the applicator shaft 4 and to optimize the amount of the makeup liquid held by the applicator.

The user shakes the container body so as to agitate the makeup liquid in the container body 1 as required, so that undesirable thickening or solidification of the makeup liquid, as well as deposition of the same to the inner surface of the container body l, can be avoided advantageously. In addition, the shaking of the container body 1 causes the slider 5M to slide up and down along the inner surface of the container body 1, whereby any makeup liquid depositing to the inner surface of the container body 1 can be scraped off this surface.

A practical arrangement of this embodiment will be described hereinafter. The container body 1 has a cylindrical member **1*a* made of a decorative metallic material and equipped with a bottom, and a mouth member 12 having an open neck 7 and fixed in the top opening of the cylindrical member 1*a*. The open neck 7 is threaded at its outer surface. The mouth member 7 has a lower mounting peripheral wall 90 with an engaging ridge 89 protruding outward from the outer surface thereof. An elastic annular member 91 with a part having a substantially U-shaped cross-section and provided with an engaging ridge 92 is secured to the mounting peripheral wall 90 in such a manner as to cover the underside of the mounting peripheral wall 10, with the engaging ridge thereof held in engagement with the engaging ridge 89 on the mounting peripheral wall 90. The elastic annular member 91** provides a liquid-tight seal and also serves as a buffer member.

The squeezing sleeve 2 is made of a soft elastic material such as a rubber or a soft synthetic resin and is provided at its upper end with an outwardly extending flange 53 adapted to rest on the top of the open neck 7. The squeezing sleeve 2 also is provided at its intermediate portion with an engaging ridge 94 protruding from outer surface thereof so as to engage with the engaging ridge 93 on the open neck 7. The lower end opening of the squeezing sleeve 2 provides a squeezing opening which makes a resilient pressure contact with the outer surface of the applicator shaft 4.

The inner peripheral surface of the cap 3 is threaded at its lower portion and an engaging ridge 95 is formed to protrude from the portion of the inner peripheral surface immediately above the thread.

The applicator shaft 4 has an upper tubular portion 96 which is fittingly received in the peripheral wall of the cap 3 with an engaging ridge 97 on the outer surface thereof held in engagement with the engaging ridge 95, whereby the applicator shaft 4 is fixed to the cap 3. When the cap 3 is properly fitted on the open neck 7 of the container body 1, the applicator shaft 4 extends downward through the squeezing sleeve 2 into the container body 1. A makeup liquid applicator 8M such as a brush is secured to the end of the applicator shaft 4 opposite to the cap 3.

As will be seen from FIG. 26, a slider 5M has a short cylindrical member 100 with a flange 101 extending inwardly from the lower end thereof. A plurality of legs 102 are extended downward from the lower face of the flange 21 at a predetermined circumferential interval. A skirt 103 extends downward from the lower end of the short cylindrical member 100 so as to make a slight pressure contact with the inner peripheral surface of the container body 1. A weight 104 in the form of a short cylinder fits in the skirt 103. An engaging ridge 105 provided on the top of the short cylindrical member 100 and projecting inwardly therefrom makes a resilient pressure contact with the top of the weight 104 so as to prevent the weight 104 from coming off the slider 5M.

In this embodiment, all the components other than the weight 104 may be molded from a synthetic resin.

As has been described, in this embodiment of the present invention, a slider 5M in the form of a short cylinder is received in the container body 1 in slight pressure contact with the inner surface of the container body 1 such that it slides up and down in sliding contact with the inner surface of the container body 1 when the container body 1 is shaken for the purpose of agitation of the makeup liquid in the container 1. It is therefore possible to effectively prevent solidification and deposition of the makeup liquid and to scrape depositing makeup liquid off the inner surface of the container body 1.

What is claimed is:

1. A makeup liquid container with an applicator, comprising:

an elongated container body having an opening and containing a makeup liquid;

a squeezing sleeve fixedly fitted in the opening of said container body;

a cap screwed to the outer surface of an open neck of said container body;

an applicator shaft fixed at its one end to said cap and extending downward therefrom into said container body through said squeezing sleeve;

an applicator fixed to the other end of said applicator shaft; and a cylindrical slider received in said container body, said slider comprising a cylindrical member and a weight, the cylindrical member having a skirt in slight pressure contact with the inner surface of said container body and movable up and down along said inner surface of said container body so as to scrape makeup liquid off said inner surface of said container body when said container is shaken up and down.

* * * * *